US007674184B2

(12) United States Patent
Briggs et al.

(10) Patent No.: US 7,674,184 B2
(45) Date of Patent: Mar. 9, 2010

(54) INTERACTIVE WATER ATTRACTION AND QUEST GAME

(75) Inventors: Rick A. Briggs, Springfield, IL (US); Denise Chapman Weston, Wakefield, RI (US)

(73) Assignee: Creative Kingdoms, LLC, Wakefield, RI (US)

( * ) Notice: Subject to any disclaimer, the term of this patent is extended or adjusted under 35 U.S.C. 154(b) by 918 days.

(21) Appl. No.: 11/406,521

(22) Filed: Apr. 18, 2006

(65) Prior Publication Data

US 2006/0258471 A1 Nov. 16, 2006

Related U.S. Application Data

(63) Continuation-in-part of application No. 10/632,556, filed on Aug. 1, 2003, now Pat. No. 7,029,400.

(60) Provisional application No. 60/400,430, filed on Aug. 1, 2002.

(51) Int. Cl.
*A63H 23/10* (2006.01)
*A63H 23/00* (2006.01)

(52) U.S. Cl. ..... 472/128; 463/40

(58) Field of Classification Search ..... 472/136, 472/133, 128, 117; 463/40, 41, 42, 43, 1; 273/440; 482/35, 36
See application file for complete search history.

(56) References Cited

U.S. PATENT DOCUMENTS 2,752,725 A 7/1956 Unsworth
3,135,512 A 6/1964 Taylor
3,395,920 A 8/1968 Moe
3,707,055 A 12/1972 Pearce
3,997,156 A 12/1976 Barlow et al.
4,063,111 A 12/1977 Dobler
4,282,681 A 8/1981 McCaslin (Continued)

FOREIGN PATENT DOCUMENTS

EP 0 546 844 6/1993

(Continued)

OTHER PUBLICATIONS

Pajama Sam: No Need To Hide When It's Dark Outside Infogames, Sep. 6, 2002.

(Continued)

*Primary Examiner*—Kien T Nguyen
(74) *Attorney, Agent, or Firm*—Knobbe, Martens, Olson & Bear, LLP

(57) ABSTRACT

A system of interactive game play is provided wherein the gaming is carried out within a pool, water park or water attraction. The game utilizes electronically identifiable objects, such as waterproof wands, cards, bands, tags and/or the like, to provide an interactive game play experience generally simulative of a computer adventure game. Play participants are challenged to work and cooperate with other play participants to find and use identified objects, clues or other information to solve various puzzles or problems that present encumbrances inhibiting participants' advancement in the game. Each play participant may possess a unique RFID wand, band, card or the like, that electronically identifies the play participant and enables the play system to award and track points or other rewards to successful play participants individually or working with other play participants as a team.

20 Claims, 6 Drawing Sheets

HARVEST QUEST CONSOLE
"Simple, Repair & Bug Reader"
1. Push button to activate reader.
2A. Light lights up.
2B. Place card on reader for points.
2C. Read display for points.

U.S. PATENT DOCUMENTS

| | | | |
|---|---|---|---|
| 4,296,929 | A | 10/1981 | Meyer et al. |
| 4,412,205 | A | 10/1983 | Von Kemenczky |
| 4,678,450 | A | 7/1987 | Scolari et al. |
| 4,695,058 | A | 9/1987 | Carter, III et al. |
| 4,858,930 | A | 8/1989 | Sato |
| 4,891,032 | A | 1/1990 | Davis |
| 4,967,321 | A | 10/1990 | Cimock |
| 5,011,161 | A | 4/1991 | Galphin |
| 5,036,442 | A | 7/1991 | Brown |
| 5,114,155 | A | 5/1992 | Tillery et al. |
| 5,114,344 | A | 5/1992 | Fumagalli et al. |
| 5,194,006 | A | 3/1993 | Zaenglein, Jr. |
| 5,194,048 | A | 3/1993 | Briggs |
| 5,236,200 | A | 8/1993 | McGregor et al. |
| 5,292,124 | A | 3/1994 | Carpenter |
| 5,320,358 | A | 6/1994 | Jones |
| 5,320,362 | A | 6/1994 | Bear et al. |
| 5,356,343 | A | 10/1994 | Lovetere |
| 5,365,214 | A | 11/1994 | Angott et al. |
| 5,366,229 | A | 11/1994 | Suzuki |
| 5,378,197 | A | 1/1995 | Briggs |
| 5,382,026 | A | 1/1995 | Harvard et al. |
| 5,405,294 | A | 4/1995 | Briggs |
| 5,411,269 | A | 5/1995 | Thomas |
| 5,435,569 | A | 7/1995 | Zilliox |
| 5,453,758 | A | 9/1995 | Sato |
| 5,482,510 | A | 1/1996 | Ishii et al. |
| 5,488,362 | A | 1/1996 | Ullman et al. |
| 5,498,002 | A | 3/1996 | Gechter |
| 5,550,721 | A | 8/1996 | Rapisarda |
| 5,580,319 | A | 12/1996 | Hamilton |
| 5,587,740 | A | 12/1996 | Brennan |
| 5,613,913 | A | 3/1997 | Ikematsu et al. |
| 5,647,796 | A | 7/1997 | Cohen |
| 5,651,049 | A | 7/1997 | Easterling et al. |
| 5,655,053 | A | 8/1997 | Renie |
| 5,662,525 | A | 9/1997 | Briggs |
| 5,674,128 | A | 10/1997 | Holch et al. |
| 5,751,273 | A | 5/1998 | Cohen |
| 5,757,305 | A | 5/1998 | Xydis |
| 5,757,360 | A | 5/1998 | Nitta et al. |
| 5,775,998 | A | 7/1998 | Ikematsu et al. |
| 5,785,592 | A | 7/1998 | Jacobsen |
| 5,786,626 | A | 7/1998 | Brady et al. |
| 5,810,666 | A | 9/1998 | Mero et al. |
| 5,811,896 | A | 9/1998 | Grad |
| 5,820,471 | A | 10/1998 | Briggs |
| 5,820,472 | A | 10/1998 | Briggs |
| 5,830,065 | A | 11/1998 | Sitrick |
| 5,835,576 | A | 11/1998 | Katz |
| 5,836,817 | A | 11/1998 | Acres et al. |
| 5,851,149 | A | 12/1998 | Xidos et al. |
| 5,853,332 | A | 12/1998 | Briggs |
| 5,855,372 | A | 1/1999 | Thiemann |
| 5,855,483 | A | 1/1999 | Collins et al. |
| 5,865,680 | A | 2/1999 | Briggs |
| 5,924,695 | A | 7/1999 | Heykoop |
| 5,942,969 | A | 8/1999 | Wicks |
| 5,944,533 | A | 8/1999 | Wood |
| 5,946,444 | A | 8/1999 | Evans et al. |
| 5,963,136 | A | 10/1999 | O'Brien |
| 5,964,660 | A | 10/1999 | James et al. |
| 5,967,901 | A | 10/1999 | Briggs |
| 5,984,788 | A | 11/1999 | Lebensfeld et al. |
| 5,996,033 | A | 11/1999 | Chiu-Hao |
| 6,009,458 | A | 12/1999 | Hawkins et al. |
| 6,012,984 | A | 1/2000 | Roseman |
| 6,025,830 | A | 2/2000 | Cohen |
| 6,075,443 | A | 6/2000 | Schepps et al. |
| 6,089,987 | A | 7/2000 | Briggs |
| 6,129,549 | A | 10/2000 | Thompson |
| 6,132,318 | A | 10/2000 | Briggs |
| 6,144,367 | A | 11/2000 | Berstis |
| 6,150,947 | A | 11/2000 | Shima |
| 6,154,723 | A | 11/2000 | Cox et al. |
| 6,162,123 | A | 12/2000 | Woolston |
| 6,186,902 | B1 | 2/2001 | Briggs |
| 6,196,893 | B1 | 3/2001 | Casola et al. |
| 6,200,216 | B1 | 3/2001 | Peppel |
| 6,210,287 | B1 | 4/2001 | Briggs |
| 6,220,965 | B1 | 4/2001 | Hanna et al. |
| 6,224,486 | B1 | 5/2001 | Walker et al. |
| 6,231,451 | B1 | 5/2001 | Briggs |
| 6,234,803 | B1 | 5/2001 | Watkins |
| RE37,220 | E | 6/2001 | Rapisarda et al. |
| 6,248,019 | B1 | 6/2001 | Mudie et al. |
| 6,254,101 | B1 | 7/2001 | Young |
| 6,254,394 | B1 | 7/2001 | Draper et al. |
| 6,261,180 | B1 | 7/2001 | Lebensfeld et al. |
| 6,265,984 | B1 | 7/2001 | Molinaroli |
| 6,273,425 | B1 | 8/2001 | Westfall et al. |
| 6,280,327 | B1 | 8/2001 | Leifer et al. |
| 6,283,862 | B1 | 9/2001 | Richter |
| 6,283,871 | B1 | 9/2001 | Briggs |
| 6,290,566 | B1 | 9/2001 | Gabai et al. |
| 6,302,793 | B1 | 10/2001 | Fertitta, III et al. |
| 6,302,796 | B1 | 10/2001 | Lebensfeld et al. |
| 6,311,982 | B1 | 11/2001 | Lebensfeld et al. |
| 6,320,495 | B1 | 11/2001 | Sporgis |
| 6,328,648 | B1 | 12/2001 | Walker et al. |
| 6,330,427 | B1 | 12/2001 | Tabachnik |
| 6,332,840 | B1 | 12/2001 | Nishiumi et al. |
| 6,342,010 | B1 | 1/2002 | Slifer |
| 6,352,478 | B1 | 3/2002 | Gabai et al. |
| 6,368,177 | B1 | 4/2002 | Gabai et al. |
| 6,369,908 | B1 | 4/2002 | Frey et al. |
| 6,371,375 | B1 | 4/2002 | Ackley et al. |
| 6,375,578 | B1 | 4/2002 | Briggs |
| 6,383,079 | B1 | 5/2002 | Takeda et al. |
| 6,404,409 | B1 | 6/2002 | Solomon |
| 6,409,379 | B1 | 6/2002 | Gabathuler et al. |
| 6,414,589 | B1 | 7/2002 | Angott et al. |
| 6,426,741 | B1 | 7/2002 | Goldsmith et al. |
| 6,463,257 | B1 | 10/2002 | Wood |
| 6,463,859 | B1 | 10/2002 | Ikezawa |
| 6,482,067 | B1 | 11/2002 | Pickens |
| 6,490,409 | B1 | 12/2002 | Walker |
| 6,494,457 | B2 | 12/2002 | Conte et al. |
| 6,509,217 | B1 | 1/2003 | Reddy |
| 6,525,660 | B1 | 2/2003 | Surintrspanont |
| 6,526,158 | B1 | 2/2003 | Goldberg |
| 6,527,646 | B1 | 3/2003 | Briggs |
| 6,530,841 | B2 | 3/2003 | Bull et al. |
| 6,551,188 | B2 | 4/2003 | Toyama et al. |
| 6,565,438 | B2 | 5/2003 | Ogino |
| 6,569,023 | B1 | 5/2003 | Briggs |
| 6,589,120 | B1 | 7/2003 | Takahashi |
| 6,592,461 | B1 | 7/2003 | Raviv et al. |
| 6,626,728 | B2 | 9/2003 | Holt |
| 6,629,019 | B2 | 9/2003 | Legge et al. |
| 6,632,142 | B2 | 10/2003 | Keith |
| 6,634,949 | B1 | 10/2003 | Briggs et al. |
| 6,641,482 | B2 | 11/2003 | Masuyama et al. |
| 6,651,268 | B1 | 11/2003 | Briggs |
| 6,676,524 | B1 | 1/2004 | Botzas |
| 6,682,074 | B2 | 1/2004 | Weston |
| 6,702,672 | B1 | 3/2004 | Angell et al. |
| 6,709,336 | B2 | 3/2004 | Siegel et al. |
| 6,716,102 | B2 | 4/2004 | Whitten et al. |
| 6,729,934 | B1 | 5/2004 | Driscoll et al. |
| 6,746,334 | B1 | 6/2004 | Barney |
| 6,761,637 | B2 | 7/2004 | Weston et al. |
| 6,773,325 | B1 | 8/2004 | Mawle et al. |
| 6,773,344 | B1 | 8/2004 | Gabai et al. |

| | | | |
|---|---|---|---|
| 6,786,830 | B2 | 9/2004 | Briggs et al. |
| 6,796,908 | B2 | 9/2004 | Weston |
| 6,846,238 | B2 | 1/2005 | Wells |
| 6,872,139 | B2 | 3/2005 | Sato et al. |
| 6,894,686 | B2 | 5/2005 | Stamper et al. |
| 6,902,483 | B2 | 6/2005 | Lin |
| 6,918,833 | B2 | 7/2005 | Emmerson et al. |
| 6,932,698 | B2 | 8/2005 | Sprogis |
| 6,932,706 | B1 | 8/2005 | Kaminkow |
| 6,939,232 | B2 | 9/2005 | Tanaka et al. |
| 6,967,563 | B2 | 11/2005 | Bormaster |
| 6,967,566 | B2 | 11/2005 | Weston et al. |
| 6,982,697 | B2 | 1/2006 | Wilson et al. |
| 7,029,400 | B2 | 4/2006 | Briggs |
| 7,066,781 | B2 | 6/2006 | Weston |
| RE39,818 | E | 9/2007 | Slifer |
| 7,445,550 | B2 | 11/2008 | Barney et al. |
| 2002/0005787 | A1 | 1/2002 | Gabai et al. |
| 2002/0032067 | A1 | 3/2002 | Barney |
| 2002/0038267 | A1 | 3/2002 | Can et al. |
| 2002/0052238 | A1 | 5/2002 | Muroi |
| 2002/0090992 | A1 | 7/2002 | Legge et al. |
| 2002/0107591 | A1 | 8/2002 | Gabai et al. |
| 2003/0022736 | A1 | 1/2003 | Cass |
| 2003/0027634 | A1 | 2/2003 | Matthews, III |
| 2003/0069077 | A1 | 4/2003 | Korienek |
| 2003/0134679 | A1 | 7/2003 | Siegel et al. |
| 2003/0195046 | A1 | 10/2003 | Bartsch |
| 2003/0234914 | A1 | 12/2003 | Solomon |
| 2004/0033833 | A1 | 2/2004 | Briggs et al. |
| 2004/0077423 | A1 | 4/2004 | Weston et al. |
| 2004/0204240 | A1 | 10/2004 | Barney |
| 2005/0059503 | A1 | 3/2005 | Briggs et al. |
| 2005/0143173 | A1 | 6/2005 | Barney et al. |
| 2005/0156883 | A1 | 7/2005 | Wilson et al. |
| 2005/0277465 | A1 | 12/2005 | Whitten et al. |
| 2006/0154726 | A1 | 7/2006 | Weston et al. |
| 2007/0066396 | A1 | 3/2007 | Weston et al. |
| 2008/0014835 | A1 | 1/2008 | Weston et al. |

FOREIGN PATENT DOCUMENTS

| | | |
|---|---|---|
| JP | 3-210622 | 9/1991 |
| JP | 09-149915 | 10/1997 |
| JP | 10-235019 | 8/1998 |
| JP | 2000-33184 | 2/2000 |
| JP | 2000-308756 | 11/2000 |
| JP | 2001-265521 | 9/2001 |
| JP | 2002-78969 | 3/2002 |
| JP | 2002-126375 | 8/2002 |
| WO | PCT/US97/01811 | 8/1997 |
| WO | WO 00/33168 | 6/2000 |
| WO | WO 02/47013 | 6/2002 |
| WO | WO 03/043709 | 5/2003 |
| WO | WO 03/044743 A2 | 5/2003 |

OTHER PUBLICATIONS

Digital ID Cards The next generation of 'smart' cards will have more than a one-track mind. Wall Street Journal, Jun. 25, 2001.

"Raise High the 3D Roof Beam: Kids shape these PC games as they go along." By Anne Field, article as featured in Business Week 2001.

Tech Designers Rethink Toys: Make Them Fun/Toy Designers Use Technology in New Ways as Sector Matures. Wall Street Journal, Dec. 17, 2001.

"Enchanted Spell-Casting Sorcerers Wand" by Ken Holt as featured on www.inventionconnection.com online advertisement (Dec. 2002).

"Owl Magic Wand and Owl Magic Orb" Press Release by Emerald Forest Toys (Nov. 2001).

"The Magic Labs Conjure Wands" as featured on www.magic-lab.com Product Specification Dec. 2002.

"Toy Wand Manufacturer Selects MEMSIC Sensor: Magic Labs cuts costs with MEMSIC sensor" Press Release by MEMSIC, Inc. as featured on www.memsic.com May 2002.

"Ollivanders: Makers of Fine Wands." Dec. 2, 2002. [online] [retrieved on Mar. 30, 2005], Retrieved from Internet <URL:http//www.cim.mcgill.edu/!jer/courses/hci/assignments/2002/www.ece.mcgill.ca/%7Eeuryd>.

Richard Borovoy et al., "Groupwear: Nametags That Tell About Relationships," Chi 98, Apr. 1998, pp. 329-330.

Jonathan Green et al., "Camping in the Digital Wilderness: Tents and Flashlights As Interfaces to Virtual Worlds," Chi 2002, Apr. 2002, pp. 780-781.

Vanessa Colella et al., "Participatory Simulations: Using Computational Objects to Learn about Dynamic Systems," Chi 98; Apr. 1998, pp. 9-10.

R. Borovoy et al., "Things that Blink: Computationally Augmented Name Tags," IBM Systems Journal, vol. 35, Nos. 3 & 4, 1996; pp. 488-495.

Resnick et al; Digital Manipulatives: New Toys to Think With; Apr. 1998; 7 pages.

Druin et al; Robots: Exploring New Technologies for Learning for Kids; 2000; Chapter One: To Mindstorms and Beyond; 27 pages.

Badler et al; "Multi-Dimensional Input Techniques and Articulated Figure Positioning by Multiple Constraints", Interactive 3D Graphics, Oct. 1986; pp. 151-169.

Cheok et al; "Micro-Accelerometer Based Hardware Interfaces fro Wearable Computer Mixed Reality Applications," 6$^{th}$ International Symposium on Wearable Computers (ISWC'02), 8 pages.

HARVEST QUEST CONSOLE
"Simple, Repair & Bug Reader"
1. Push button to activate reader.
2A. Light lights up.
2B. Place card on reader for points.
2C. Read display for points.

INTERACTIVE WATER ATTRACTION AND QUEST GAME

RELATED APPLICATIONS

This application is a continuation-in-part of and claims benefit of priority under 35 U.S.C. §120 from U.S. patent application Ser. No. 10/632,556, filed Aug. 1, 2003, now U.S. Pat. No. 7,029,400, issued Apr. 18, 2006, which claims priority under 35 U.S.C. §119(e) to U.S. Provisional Application No. 60/400,430, filed Aug. 1, 2002, each of which is hereby incorporated by reference in its entirety to be considered as part of this specification.

FIELD OF THE INVENTION

The present invention relates to interactive attractions and games and, in particular, to interactive water play attractions utilizing electronically-identifiable objects or tags to provide a unique interactive water play experience.

DESCRIPTION OF THE RELATED ART

The popularity of family-oriented theme parks and commercial recreational facilities has increased steadily in recent years. Water parks, in particular, have proliferated as adults and children alike seek the thrill and entertainment of water attractions as a healthy and enjoyable way to cool off during the hot summer months. For example, water parks typically incorporate a variety of different water attractions, such as wave pools and/or water slides, for the enjoyment of participants.

However, there is always a demand for more exciting and entertaining water play attractions and games that increase the learning and entertainment opportunities for children and that stimulate creativity and imagination.

SUMMARY OF THE INVENTION

Embodiments of the invention provide unique water play attractions, game systems and methods of game play wherein gaming is carried out within a themed water play attraction comprising an existing or specially configured entertainment water play facility and/or water play structure. Certain games utilize electronically identifiable objects, such as colored balls, shaped objects, cards, bands, radio frequency identification (RFID) tagged objects and/or the like, to provide an interactive game play experience generally simulative of a computer adventure game experience. Play participants are challenged to work and cooperate with other play participants to find identified objects, clues and/or other information and to use the objects, clues and/or information to solve various puzzles or problems that present encumbrances inhibiting a player's advancement in the game.

In certain embodiments, each play participant preferably possesses a band, card or the like, that electronically identifies the play participant and that enables the play system to award and/or track points or other rewards to successful play participants individually or working with other play participants as a team. Thus, play participants participate in a computer-orchestrated adventure game, while using a physical play space and physical objects to overcome both physical and mental challenges presented by the game.

In accordance with one embodiment the present invention provides a method and system of interactive game play carried out within a water park. The game includes a plurality of electronically distinguishable play objects and one or more consoles or stations adapted to distinguish the play objects electronically. The game challenges play participants to find and use identified objects in identified consoles.

In accordance with another embodiment the present invention provides a method game play wherein play participants participate in a computer driven adventure game as they float or swim around a lazy river or other swimming channel, and using physical and/or electronic objects capable of interacting electronically with the computer driven gaming system.

In accordance with another embodiment the present invention provides a modified computer game carried out by one or more play participants within a themed water-play structure using a computer interface comprising wireless identification tags worn by play participants and electronically identifiable play objects. Optional redemption coupons, tickets, prize and/or the like may be awarded to play participants as they successfully complete each task.

In certain embodiments, an interactive water attraction is disclosed. The interactive water attraction includes a plurality of electronically identifiable objects, each comprising identification information associated with one of a plurality of play participants. The interactive water attraction also includes a plurality of consoles distributed in or near a body of water sized to accommodate at least one of the plurality of play participants. Each of the plurality of consoles may be configured to receive the identification information from at least one of the plurality of electronically identifiable objects, wherein the plurality of consoles may be further configured to play one or more games with the at least one play participant such that the at least one play participant is able to progress in the one or more games by completing at least one challenge. Furthermore, the plurality of consoles may optionally be configured for wireless communication (for example, RF communication) with the plurality of electronically identifiable objects. In addition, at least one of the plurality of electronically identifiable objects may optionally comprise a toy wand, such as for example, a water resistant toy wand or a toy wand having an RFID tag for storing the identification information.

In certain embodiments, an interactive water play attraction is disclosed for entertaining one or more play participants. The interactive water play attraction comprises a plurality of water resistant, electronically identifiable objects. The interactive water play attraction also comprises one or more game consoles configured to wirelessly communicate with at least one of the electronically identifiable objects during one or more interactive games, wherein the one or more game consoles are located in or around a body of water, and whereby a plurality of play participants use the plurality of electronically identifiable objects to play the one or more interactive games. In certain embodiments, the body of water may optionally comprise a pool, a water slide, a lazy river water ride, combinations of the same or the like. In certain embodiments, the at least one electronically identifiable object may comprise a toy wand, wherein the one or more game consoles are configured to produce one or more play effects based on information received from the toy wand.

In certain embodiments, a water attraction is disclosed for interactive game play. The water attraction includes means for electronically identifying play participants in an interactive water game environment, wherein the means for electronically identifying is water resistant. The water attraction also includes means for wirelessly communicating with the means for electronically identifying, the means for wirelessly communicating being disposed in or around multiple locations of a body of water. The means for wirelessly communicating may be further configured to play an interactive game with at least one play participant in possession of at least one of said means for electronically identifying such that the at least one play participant completes various challenges to progress in the interactive game.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF PREFERRED EMBODIMENTS

Basic System and Framework

Figure 1:
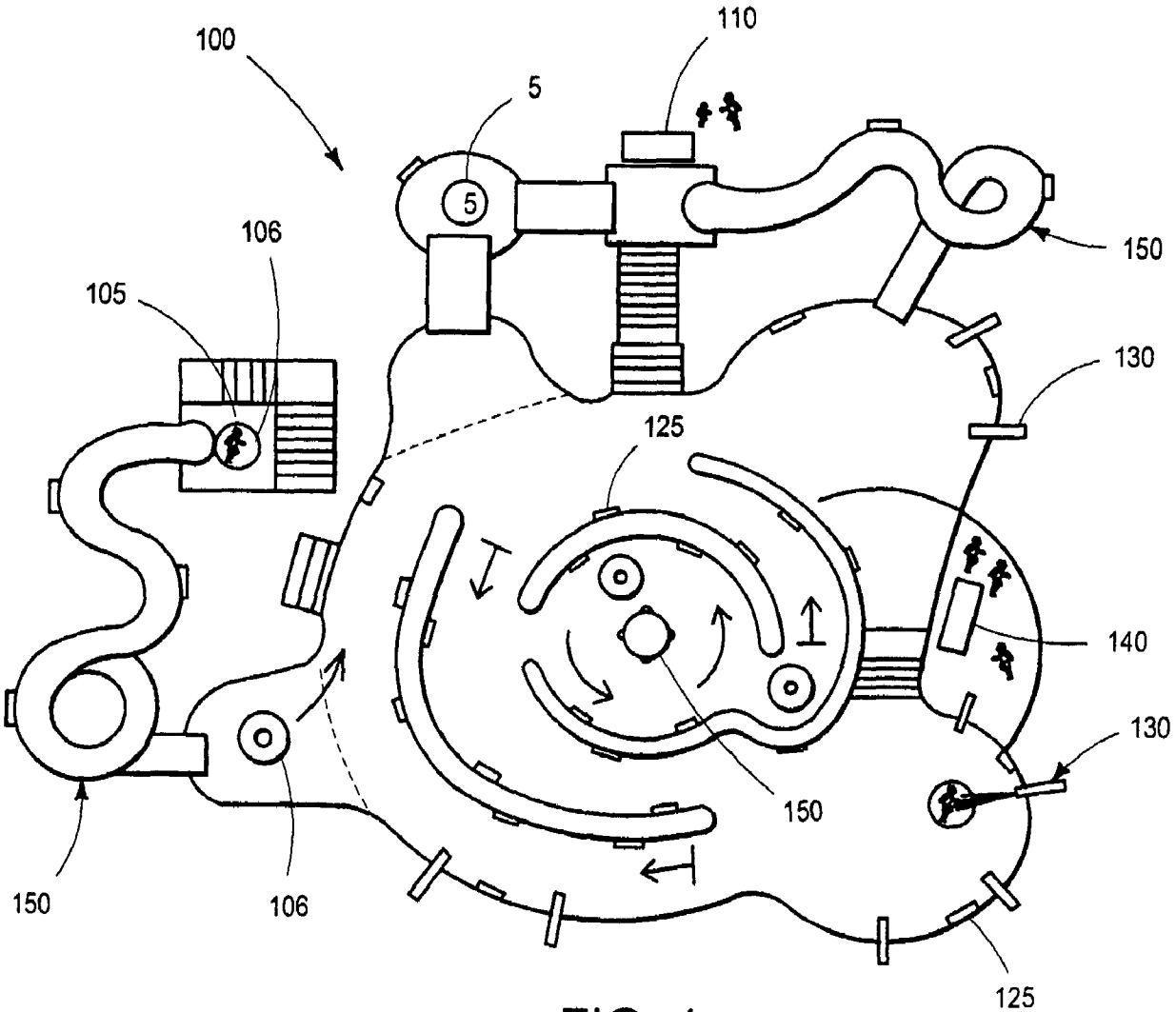
FIG. 1 is a schematic plan view of one embodiment of an RFID interactive water play attraction incorporating features and advantage in accordance with embodiments of the invention.

FIG. 1 illustrates one preferred embodiment of an interactive water play attraction 100 configured and adapted to facilitate an interactive game having features and advantages in accordance with the present invention. In certain embodiments, the interactive water play attraction includes and/or is associated with a body of water, such as, for example, one or more pools, waterslides, lazy river attractions, combinations of the same or the like.

For ease of description and understanding, the particular water attraction 100 illustrated is laid out in one level. However, those skilled in the art will readily appreciate that such an attraction may also be constructed and laid out in multiple levels, as desired, including multiple play levels, rooms, and various themed slides, chutes, climbing nets, and/or other play devices or props to be enjoyed by multiple play participants. Within the water play attraction 100, play participants 105 may ride on inner tubes 106 and/or other float vehicles as they embark on a quest to find and use various electronically-identifiable objects to solve problems, find lost treasure and/or the like.

Furthermore, certain water slides may include a number of sensors (for example, photo sensors) that are actuated by play participants sliding down the water slide to activate one or more associated play effects. Other water play systems may also be included that provide an exciting water effect that includes a giant bucket or container for collecting water discharged from a water forming device. The container is balanced and conditionally stable so that it periodically spills over when the water level in the container reaches a predetermined level. This system creates dramatic visual and sound effects for surprising, entertaining and amusing play participants.

Preferably, each play participant 105 and/or group of participants is uniquely identified via an RFID tag, card, bracelet combinations of the same or the like (described in more detail below). Identification information, such as play participant's name, age, group affiliation, or the like, may be entered using a registration station 110 located adjacent the water play attraction 100. A plurality of interactive consoles 125 are distributed throughout the structure of the water play attraction 100. Each console 125 is preferably equipped with an RFID reader adapted to electronically identify play participants via one or more wireless RFID tags or bands worn or possessed by play participants.

Optional points, redemption coupons, tickets, prize and/or the like may be awarded to play participants as they successfully complete each task. These may be printed using a dispenser or the like and/or may be recorded electronically via the RFID tag. Thus, as each play participant moves throughout the water attraction and interacts with various interactive devices comprising the game and distributed throughout the water play attraction 100, the play system is able to track and identify relevant attributes of play each participant, such as points accumulated, levels achieved, special skills acquired, combinations of the same or the like. Play participants 105 advance in the game by successfully completing various challenges presented throughout the water play attraction 100 and/or throughout the course of game play.

In certain embodiments, points are tracked and displayed on a central score board. Scores may be reported directly to the score board by each console 125, such as via Ethernet or through wireless communication. Alternatively, an intermediate point station 140 may be used to periodically collect and report points for each play participant 105 or group of play participants. In that case, each play participant 105 may present his or her band or RFID tags to the point station 140 to determine his or her points. In certain embodiments, the point stations preferably incorporate an RFID reader, which reads the RFID tag and obtains and displays the points for each participant 105. This information is then provided to the score-board for display. Optionally, point information and other information may be communicated via a network, such as the internet, to a central host and/or one or more other interactive game centers.

Earned points may be used to receive redemption tickets, prizes and/or other incentives. For example, the point station 140 may be configured to issue redemption tickets according to total points accumulated by each play participant 105. Play participants 105 can then redeem the tickets for prizes, freebies, discounts or the like. Alternatively, the points stored on each RFID tag may be used to access and play associated games, such as video games and the like.

The water play attraction 100 preferably comprises multiple chutes and/or slides 150 feeding riders into a meandering lazy river constructed using any one of a number of materials and construction techniques well known to those skilled in the art. The water play attraction 100 may be suitable for either outdoor or indoor use, as desired.

Optionally, a suitable play media, such as foam, rubber, plastic or similar objects, may be provided for use throughout the water play attraction 100 to provide a tactile interactive play experience. For example, the play media may be in the shape of balls, animals (for example, ducks, fish, or the like), combinations of the same or the like. Optionally, a number of water conduits or other transport means may be provided throughout the framework of the water play attraction 100 for collecting and/or transporting play media to and from the various play areas in the water play attraction 100. The conduits may be formed from plastic pipes, such as channels joined together using commercially available fittings. Conduits may also be formed from a wide variety of other suitable materials such as steel pipe, ceramic or clay pipe, or they may be formed as open channels and/or runners, as desired. Various participant-operated or "magically" actuated conveyors may also be employed to circulate various play media from one area of the water play attraction 100 to another, as desired.

Optionally, the water play attraction 100 also preferably incorporates a number of conventional play elements, such as climbing nets, air bounce structures, trampolines, water cannons 130, balance beams, hanging bumper-bags, log crawl, tunnels, moon jumps, trolley slides, block walks, swinging or web bridges, slides and/or the like. Such play elements provide entertaining physical challenges and allow play participants to safely negotiate their way through the various areas of the water play attraction 100.

Slides 150 also may be provided at the various locations in and around the water attraction 100 and may be straight, curved, or spiral-shaped, as desired. The slides 150 may also be enclosed and tube-like or open and exposed to floating or flying play media, as desired. Alternatively, those skilled in the art will readily appreciate that the size, shape, number, and location of the various slides 150 can be varied, as desired, while still enjoying the benefits and advantages of embodiments of the present invention. Those skilled in the art will readily appreciate that a wide variety of other play elements, such as funny mirrors, rotating tunnels, trampolines, climbing bars, swings, combinations of the same, or the like may be used to create a desired play environment.

While a particular preferred play environment and water play attraction 100 has been described, it will be readily apparent to those skilled in the art that a wide variety of other possible water play environments, play structures, entertainment centers and the like may be used to create an interactive environment within which the invention may be carried out. For instance, details other interactive play structures usable with embodiments of the invention are disclosed and described in U.S. Pat. No. 6,375,578, entitled "TWO-WAY INTERACTIVE WATER SLIDE" and U.S. Pat. No. 5,820,471, entitled "PARTICIPATORY WATER PLAY SYSTEM," each of which is hereby incorporated herein by reference in its entirety to be considered a part of this specification. In certain embodiments, a suitable water play attraction may be constructed substantially entirely of molded or contoured concrete, fiberglass or plastic, as desired. In other embodiments, a suitable water play attraction may be provided by retrofitting an existing water park attraction, pool or lazy river attraction.

Game Play

In certain embodiments, game play begins at the introductory registration station 110, whereat the play participants 105 may register to play the game and/or input relevant information about themselves, such as name, age, group affiliation. Play participants 105 then proceed into the water play attraction 100 and to the various game consoles 125. The game consoles 125 preferably challenge play participants to complete a specified task (for example, find a hidden object (either floating or underwater) or clue, answer a multiple-choice question, push a button(s), jump over light beam sensor, combinations of the same or the like).

In certain embodiments, before play participants 105 begin the game, an RF Tag Reader/Writer reads the play participant's unique person identifier number (UPIN) and/or unique group identification number (UGIN) and confirms the participant's status. One or more of the consoles 125 then prompt the play participant 105 to complete a specified task. Once the interface senses that the requested task has been completed, the RF Tag Reader/Writer writes updated information to the play participant's RFID tag. This information may include, for example, the station number visited, updated number of points accumulated, error check bits/flags and/or various other information.

During game play, the play participant 105 may visit one or more optional point stations 140 to determine his or her status in the game, such as the participant's total points accumulated. The point station 140 may comprise a simple RF Tag Reader and associated display and/or may include a guest interface or other input device for more sophisticated functionality. Preferably, at least one point station 140 is disposed near the exit of the water play attraction 100. In certain embodiments, at the point station 140, participants 105 can verify and/or log their final point tally. The final point station preferably includes a RF Tag Reader/Writer. Various software in the final point station may be used to log and verify the final recorded score and communicate such information to the main score board. Optionally, once the score has been logged and verified, the final point station may "reset" the play participant's RFID tag so that the play participant 105 may turn in the RFID tag at the exit gate to be used by another play participant 105.

In certain embodiments, the RFID tag or like device of the play participant 105 may track and/or store information regarding the progress of the play participant 105 in the interactive water game. In yet other embodiments, one or more of the point stations 140 may be linked together, such as through a wired or wireless network, and/or the point stations 140 may communicate with a central computer that tracks the progress of each of the participants 105.

Game Consoles

In certain embodiments illustrated and described above, multiple interactive quest consoles 125 are preferably arranged throughout the water play attraction 100. For instance, one or more of the consoles 125 may be positioned or distributed on or near a body of water, such as a pool, a water slide, a lazy river attraction, combinations of the same or the like. Game consoles 125 may be out in the open or hidden, as desired.

Figure 2:
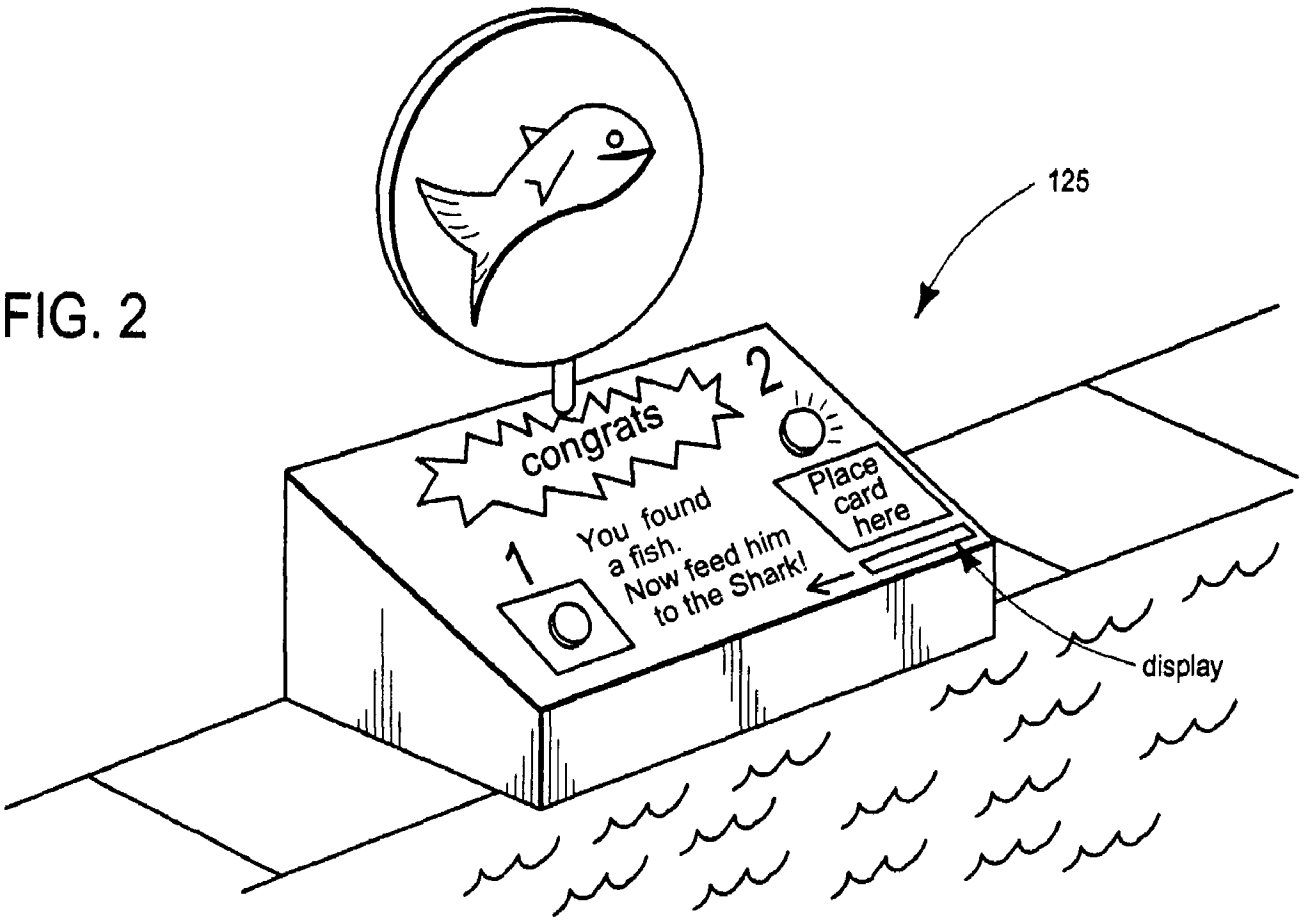
FIG. 2 is a perspective view of one embodiment of an interactive game console having features and advantages in accordance with embodiments of the invention.

One preferred embodiment of a game console 125 is illustrated in FIG. 2. In such an embodiment, the game console 125 preferably includes an RFID reader/writer adapted to read and/or write to the RFID tags or bracelets worn by play participants 105. Play participants 105 find each console 125 and use the RFID tags/bands to receive points and/or complete a game. Preferably, game play follows a story line that play participants 105 learn as they play. Play participants 105 may learn clues and/or gather objects or tools that enable them to progress through the game, solve a mystery, or complete a quest or treasure hunt. Such objects and/or tools may comprise physical and/or electronic (virtual) items.

In certain embodiments, the various consoles 125 are arranged and programmed such that they may be visited and operated in a particular order by the play participant(s) 105 to complete the game and earn a particular number of points. For example, certain consoles 125 may only be activated if the play participant 105 has already visited and received points or information from other consoles 125 within (or outside) the water play attraction 100. The game play may be similar to a typical interactive computer adventure game.

Figure 3:
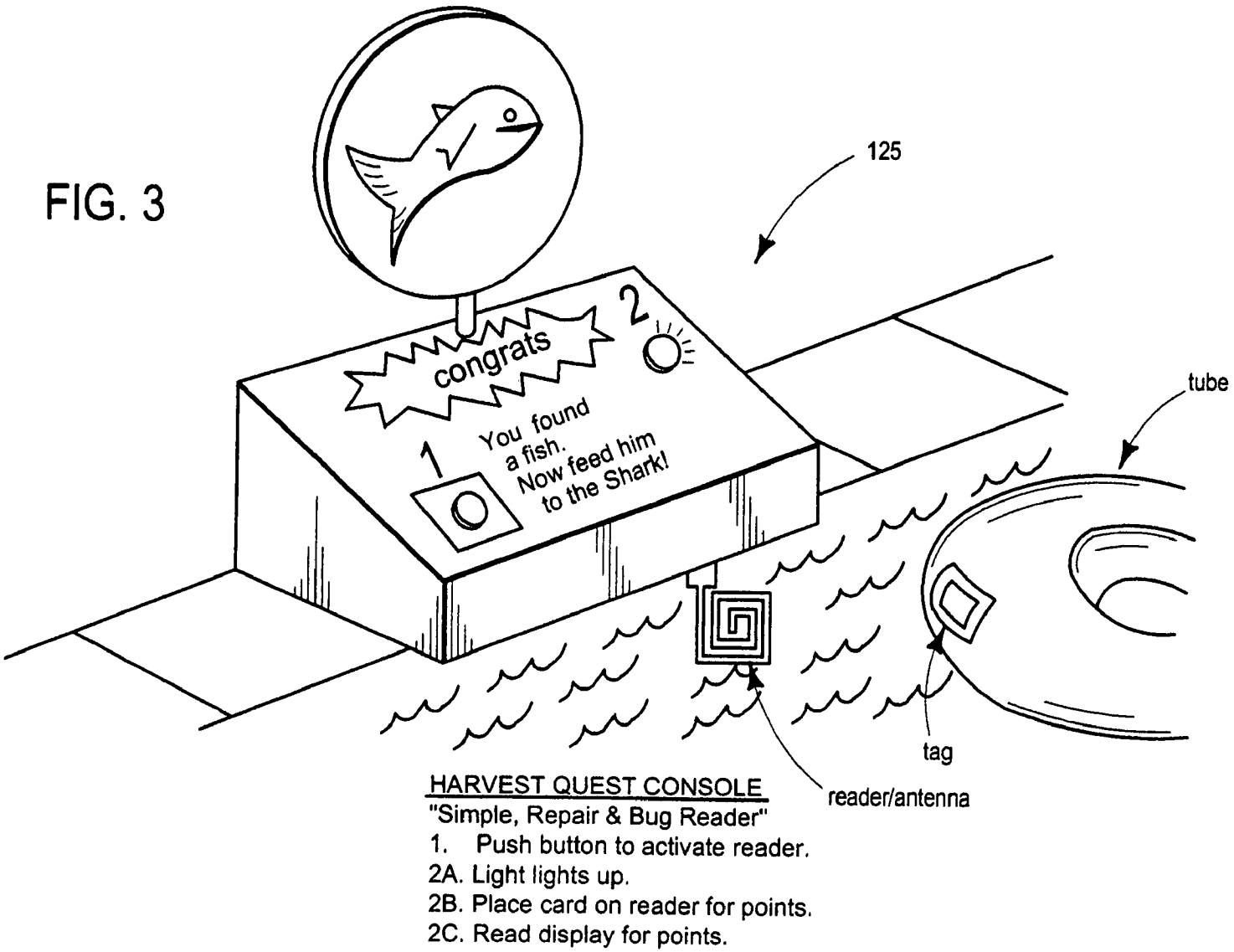
FIG. 3 is a perspective view of an alternative embodiment of an interactive game console having features and advantages in accordance with embodiments of the invention.

FIG. 3 illustrates another preferred embodiment of a game console 125. In this embodiment, the antenna or "pick up" portion of the RFID readers/writer is disposed outside the console 125 so as to more-easily communicate with one or more RFID tags, such as those affixed directly to the inner tube 106.

In certain embodiments, the consoles 125 may also be use to track the location of the play participants. For instance, one or more of the consoles 125 may provide information to central processor and/or other electronic devices regarding the current location of a play participant, a history of locations visited, or the like. Such information may be advantageously used, for example, by parents to remotely monitor the location of children throughout the game play and/or to find a lost child.

RFID Tags and Readers

As indicated above, each play participant 105 within the water play attraction 100 preferably receives an electronic identification device, such as, for example, an RFID tag or transponder ("tag"). The tag allows play participants 105 to electronically interact with the various quest consoles 125 to achieve desired goals or produce desired effects within the play environment. Play participants 105 preferably collect points and/or earn additional levels or ranks for each interactive console 125 they successfully complete. In this manner, play participants 105 may compete with one another to see who can score more points and/or achieve the highest levels in the quest game.

RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 4A:
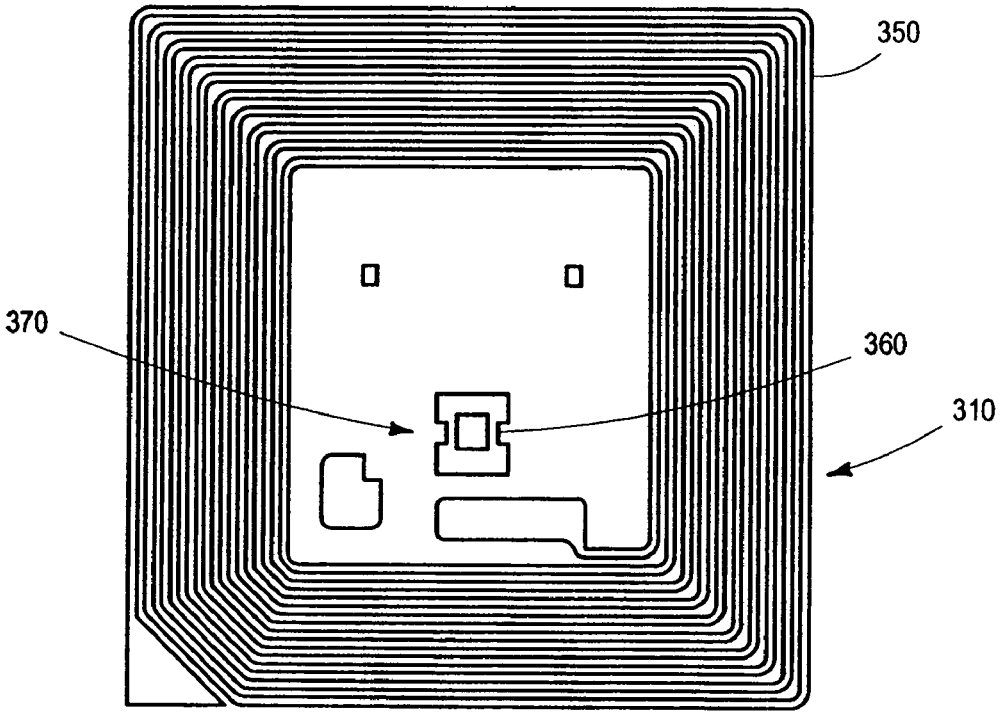
FIG. 4A is a detail plan view of one embodiment of an RFID tag device for use in accordance with one preferred embodiment of an interactive water play structure and game having features and advantages in accordance with embodiments of the invention.

FIG. 4A is a detailed schematic view of one embodiment of an RFID tag device 310 for use with certain embodiments of a water quest game. The illustrated tag 310 preferably comprises an RF tag pre-programmed with a UPIN or a quest object identification number (UOIN). Other stored information (either pre-programmed or programmed later) may include, for example, the play participant's name, age, rank or level achieved, total points accumulated, tasks completed, facilities visited, combinations of the same or the like. As shown, the tag 310 generally comprises a spiral wound antenna 350, a RF transmitter chip 360 and various electrical leads and terminals 370 connecting the chip 360 to the antenna 350.

The tag 310 may be a passive tag or battery-powered, as expedience and costs dictate. Preferably, the tag 310 is passive (requires no batteries) so that it is inexpensive to purchase and maintain. Such tags and various associated readers and other accessories are commercially available in a wide variety of configurations, sizes and read ranges. RFID tags having a read range of between about 10 centimeters to about 100 centimeters are particularly preferred, although shorter or longer read ranges may also be acceptable. The particular tag 310 illustrated is the 13.56 megahertz tag sold under the brand name TAGGIT™ available from Texas Instruments, Inc. (http://www.tiris.com, Product No. RI-103-110A).

In certain embodiments, the tag 310 has a useful read/write range of about 25 centimeters and contains 256-bits of on-board memory arranged in 8×32-bit blocks which may be programmed (written) and read by a suitably configured read/write device. If a longer read/write range (for example, 1 to 100 meters) and/or more memory (for example, 1 to 100 megabytes) is desired, optional battery-powered tags may be used instead, such as the AXCESS active RFID network system available from AXCESS, Inc. and/or various other RF-based asset and people tracking applications known to those skilled in the art.

Figure 4B:
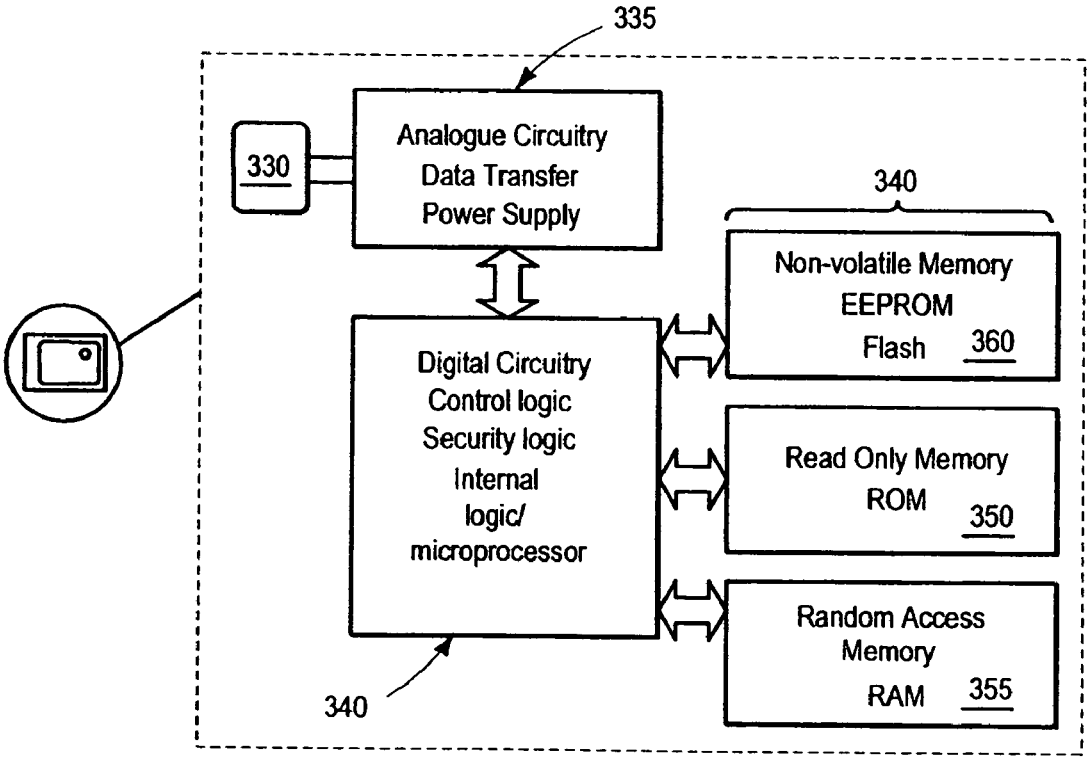
FIG. 4B is a schematic circuit diagram of one embodiment of an RFID tag device, illustrating the basic organization and function of the electronic circuitry comprising the RFID tag device of FIG. 4A for use in accordance with embodiments of the invention.

FIG. 4B is a simplified block diagram illustrating the organization and function of the electronic circuitry comprising the RF transmitter chip 360 of the RFID tag device 310 of FIG. 4A. The illustrated chip 360 comprises a processor 430, analogue circuitry 435, digital circuitry 440 and on-board memory 445. On-board memory 445 is divided into read-only memory (ROM) 450, random access memory (RAM) 455 and non-volatile programmable memory 460, which is available for data storage. The ROM-based memory 450 is used to accommodate security data and the tag operating system instructions which, in conjunction with the processor 430 and processing logic deals with the internal "house-keeping" functions such as response delay timing, data flow control and power supply switching.

The RAM-based memory 455 facilitates temporary data storage during transponder interrogation and response. The non-volatile programmable memory 460 may take various forms, such as for example electrically erasable programmable read only memory (EEPROM). In certain embodiments, the RAM-based memory 455 is used to store the transponder data and is preferably non-volatile to ensure that the data is retained when the device is in its quiescent or power-saving "sleep" state. Various data buffers or further memory components (not shown), may also be provided to temporarily hold incoming data following demodulation and outgoing data for modulation and interface with the transponder antenna 350.

Analog circuitry 335 provides the facility to direct and accommodate the interrogation field energy for powering purposes in passive transponders and triggering of the transponder response. Analog circuitry 335 also provides the facility to accept the programming or "write" data modulated signal and to perform the necessary demodulation and data transfer processes. Digital circuitry 440 provides certain control logic, security logic and internal microprocessor logic required to operate the processor 430.

Advantageously, the UPIN stored on each tag 310 may be used to wirelessly identify and track individual play participants 105 within the water play attraction 100. Optionally, each tag 310 may also include a UGIN that may be used to match one or more play participants 105 to a particular group or team. If desired, the tag 310 may be covered with an adhesive paper label (not shown) for surface adhesion to a quest object, clothes, or any other tag bearing surface. More preferably, the tag 310 may be molded and/or embedded into a relatively stiff plastic sheet substrate and/or transponder cylinder which holds and supports the tag 310. Optionally, the sheet substrate, transponder or other support structure may take on any other fanciful shape, as desired. The resulting structures may be inserted into and/or affixed to the various quest objects, and/or they may be worn externally by play participants (for example, as a bracelet, necklace, key chain trinket, sticker, name badge, or the like).

In certain embodiments, the electronically identifiable objects used by the play participants 105 in the water play attraction 100 may include one or more devices that are carried by a play participant. For example, in certain embodiments, an electronically identifiable object may comprise a toy wand that the participant 105 uses to communicate with one or more game consoles 125. The toy wand may be configured to store, such as in a memory or an RFID tag, identification information associated with the respective play participant 105. Such information may be used by one or more processors and/or by one or more game consoles 105 to track the progress of the play participant 105 in a particular interactive water game.

In certain embodiments, the toy wand may wirelessly communicate with one or more game consoles 125 through RF, infrared, or like communications. For instance, the toy wand may include an RFID tag (for example, passive RFID tag), such as is described in more detail above, that stores identification information and that communicates with an RFID reader of one or more game consoles 125.

In certain embodiments, the toy wand further comprises activation circuitry capable of wirelessly communicating one or more command signals to one or more game consoles 125 during the course of an interactive game. For instance, the activation circuitry may be responsive to one or more particular directions of the toy wand to communicate with the game console 125 and/or to cause one or more play effects, to solve a puzzle or challenge, to answer a question, combinations of the same or the like.

Examples of designs and/or circuitry of toy wands usable with embodiments of the invention are described in more detail in U.S. Patent Publication No. 2005-0143173, published Jun. 30, 2005, and entitled "MAGICAL WAND AND INTERACTIVE PLAY EXPERIENCE," which is incorporated herein by reference in its entirety.

In certain embodiments, the electronically identifiable objects, such as the toy wand, are preferably waterproof and/or water resistant. Such a design advantageously prevents internal circuitry associated with the electronically identifiable object from being adversely affected by water from the surrounding water play attraction 100. For instance, the toy wand may be constructed of a plastic, rubber or like material. In other embodiments, the toy wand may be substantially surrounded by a waterproof or water resistant covering or skin.

In operation, various RFID reader (and/or reader/writer) devices are provided and may be distributed throughout the water play attraction 100. In certain embodiments, the readers are able to read the information stored on each tag 310 when the associated participant 105 or object is brought into suitable proximity of the reader (for example, 1 to 100 centimeters). Advantageously, because radio waves can easily penetrate solid objects, such as plastic and the like, the tag 310 may be mounted internally within a cavity of the quest object, thereby providing an internal communication and information storage means for each quest object.

Tags may also be worn close to the body, such as around a participant's wrist or on/in a participant's clothing. Thus, the UPIN, UOIN and/or UGIN information may be conveniently read and easily communicated to a quest console 125, computer monitor, interactive game control system, display system or other tracking, recording or displaying device for purposes of identifying, logging and/or creating a record of each play participant's experience. Additional information (for example, unique personality traits, special powers, skill levels, or the like) may also be easily stored on each tag, thus providing further character development and interactive gaming possibilities.

Figure 5A:
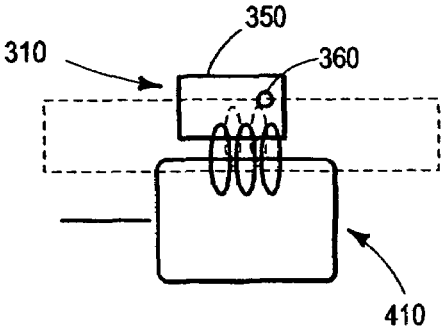
FIGS. 5A and 5B are schematic diagrams illustrating typical operation of the RFID tag device of FIG. 4.
Figure 5B:
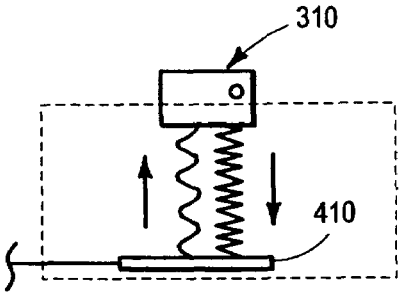
Figure 6A:
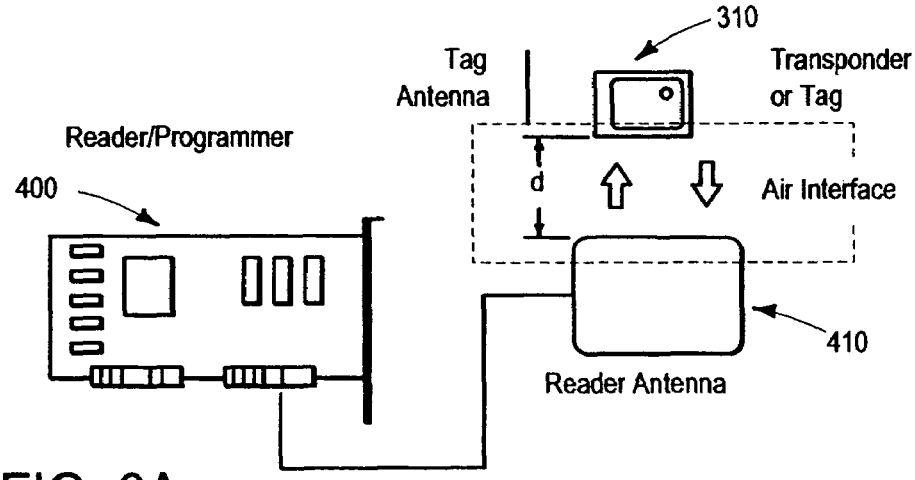
FIGS. 6A and 6B are simplified schematic diagrams of one embodiment of an RFID read/write system for use with the RFID tag device of FIG. 4 and having features and advantages in accordance with embodiments of the invention.
Figure 6B:
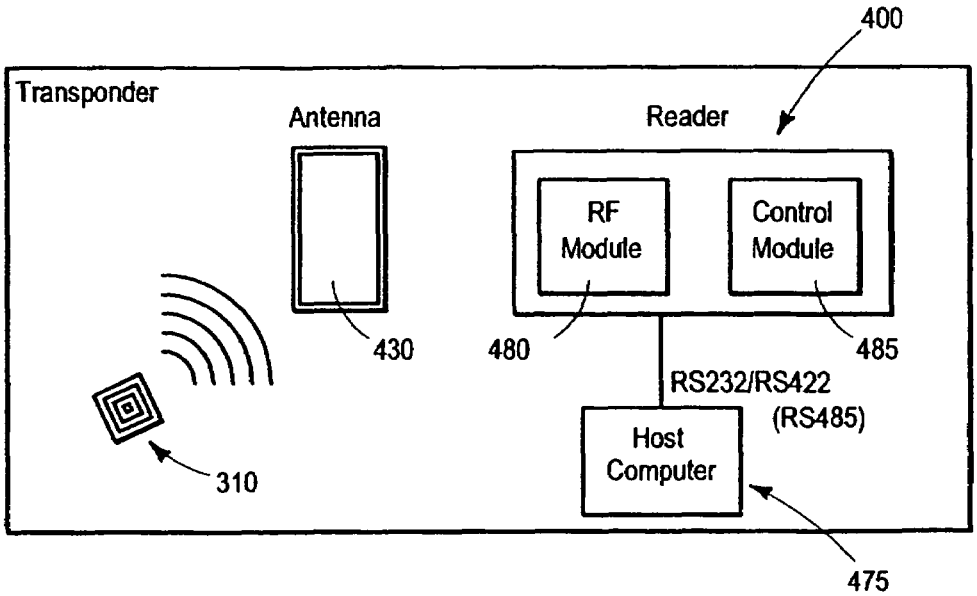
Figure 7:
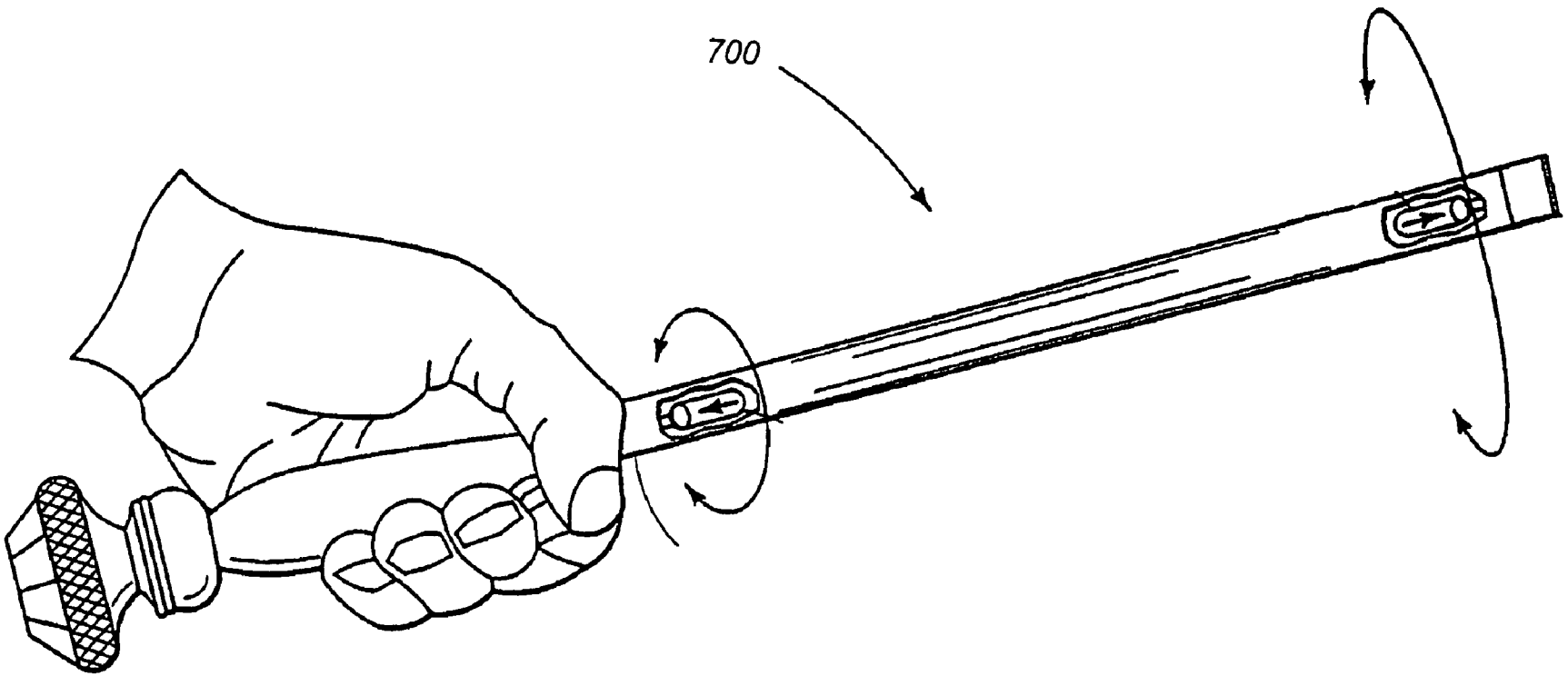
FIG. 7 illustrates one embodiment of a waterproof wand.

FIGS. 5 and 6 are simplified schematic illustrations of embodiments of a tag and reader operation. In certain embodiments, the tag 310 is initially activated by an RF signal broadcast by an antenna 410 of an adjacent reader or activation device 400. The signal impresses a voltage upon the antenna 350 by inductive coupling, which voltage is then used to power the chip 360 (see, for example, FIG. 4A). When activated, the chip 360 transmits via RF a unique identification number preferably corresponding to the UPIN, UOIN and/or UGIN described above (see, for example, FIG. 4A and associated discussion). In certain embodiments, the signal may be transmitted either by inductive coupling or, more preferably, by propagation coupling over a distance "d" determined by the range of the tag/reader combination. This signal is then received and processed by the associated reader 400, as described above, and communicated to a host computer 475. If desired, the RFID tag or transponder 310 may also be configured for read/write communications with an associated reader/writer. Thus, the unique tag identifier number (UPIN, UGIN or UO1N) and any other stored information may be read or changed, or other information may be added. FIG. 7 illustrates one embodiment of a waterproof wand device 700 that includes a tag 310.

As indicated above, in certain embodiments, communication of data between a tag and a reader is advantageously by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 400 so as to reduce the probability of such data transmission errors. In certain embodiments, the readers are preferably placed at least 30 to 60 centimeters away from metal objects, power lines or other potential interference sources. Those skilled in the art will also recognize that the write range of the tag/reader combination is typically somewhat less, such as, for example, approximately 10 to approximately 15 percent less, than the read range "d" and, thus, this should also be taken into account in determining the placement and positioning of each reader device 400.

Typical RFID data communication is asynchronous or unsynchronized in nature and, thus, particular attention should be given in considering the form in which the data is to be communicated. In certain embodiments, structuring the bit stream of the wireless communications, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are also well known to those skilled in the art and will not be further discussed herein.

The choice of carrier wave frequency is also important in determining data transfer rates. Generally speaking, the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

The water-based quest game in accordance with the above-described example provides a challenging, computer-orchestrated interactive gaming experience within a physical play space using electronically-identifiable physical objects as an interactive play medium. In yet other embodiments, wireless communications other than, or in addition to, RF communications may be used in the water-based quest game. The game provides participants with the intellectual challenge and excitement of a computer adventure game, but with tangible interactives, physical challenges, and social interaction.

Additionally, certain embodiments of the water-based games described herein may further comprise a retail phase in which a play participant may purchase, rent, or acquire one or more objects for use in the water-based quest game. For instance, a play participant may purchase one of the electronically identifiable objects (for example, a toy wand) before, during or after participating in the water-based game. Such a retail phase advantageously allows a user to retain a record of his or her progress through his or her purchased object, which may be repeatedly used in multiple games, such as games played on different days, or in other interactive games or environments, including water-based and/or non-water-based games. Further details of systems and methods for integrating interactive game play with a retail environment are disclosed in U.S. patent application Ser. No. 11/274,760, filed Nov. 15, 2005, and entitled "MULTI-LAYERED INTERACTIVE PLAY EXPERIENCE," which is hereby incorporated herein by reference in its entirety to be considered a part of this specification.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive water attraction comprising:

a plurality of electronically identifiable objects, each of the plurality of electronically identifiable objects comprising, a memory configured to store identification information associated with one of a plurality of play participants, a transceiver in communication with the memory and configured to wirelessly transmit the identification information, and a waterproof covering substantially enclosing at least the memory and the transceiver and configured to be worn on a hand of the one of the plurality of play participants; and a plurality of consoles distributed in or near a body of water on which each of the plurality of play participants travels during the course of completing an interactive game, each of the plurality of consoles being configured to wirelessly receive the identification information from at least one of the plurality of electronically identifiable objects, and wherein the plurality of consoles are further configured to provide one or more challenges to the at least one play participant based at least on said identification information such that the at least one play participant is able to progress in the interactive game by completing the one or more challenges.

2. The interactive water attraction of claim 1, wherein the memory comprises a radio frequency identification (RFID) tag.

3. The interactive water attraction of claim 2, wherein the RFID tag is a passive RFID tag.

4. The interactive water attraction of claim 1, wherein each of the a plurality of electronically identifiable objects further comprises activation circuitry configured to communicate one or more command signals to at least one of the plurality of game consoles during the one or more challenges.

5. The interactive water attraction of claim 4, wherein the activation circuitry is configured to communicate the one or more command signals in response to at least one of a plurality of particular motions of the particular electronically identifiable object.

6. The interactive water attraction of claim 1, wherein said wireless communication comprises at least one of radio frequency (RF) communication and infrared communication.

7. The interactive water attraction of claim 1, wherein the waterproof covering is in the form of a bracelet.

8. The interactive water attraction of claim 1, further comprising float vehicles on which at least a portion of the plurality of play participants travels during the course of completing the interactive game.

9. The interactive water attraction of claim 8, wherein the float vehicles comprise inner tubes.

10. An interactive water play attraction for entertaining one or more play participants, the interactive water play attraction comprising:

a plurality of electronically identifiable objects, wherein each of the plurality of electronically identifiable objects comprises, a memory configured to store identification information associated with a play participant, a transmitter in communication with the memory and configured to wirelessly transmit the identification information during one or more interactive games, and a waterproof covering substantially enclosing at least the memory and the transmitter and configured to be worn on a hand of the play participant; and one or more game consoles configured to wirelessly communicate with at least one of the electronically identifiable objects during the one or more interactive games to receive the identification information, wherein the one or more game consoles are located in or around a body of water on which a plurality of play participants travels during the course of completing the one or more interactive games, whereby a plurality of play participants use the plurality of electronically identifiable objects to play the one or more interactive games.

11. The interactive water play attraction of claim 10, wherein the body of water comprises at least one of a pool, a water slide, and a lazy river water ride.

12. The interactive water play attraction of claim 10, wherein the plurality of game consoles are further configured to provide the plurality of play participants with one or more clues or challenges that present an encumbrance to advancement in the one or more interactive games.

13. The interactive water play attraction of claim 10, wherein the one or more game consoles comprises a radio frequency identification (RFID) reader that wirelessly communicates with the at least one electronically identifiable object.

14. The interactive water play attraction of claim 10, further comprising one or more conduits for transporting at least a portion of the plurality of electronically identifiable objects between various play areas of the interactive water play attraction.

15. The interactive water play attraction of claim 10, wherein the waterproof covering is in the form of a bracelet.

16. The interactive water play attraction of claim 10, further comprising float vehicles on which at least a portion of the plurality of play participants travels during the course of completing the interactive game.

17. The interactive water play attraction of claim 16, wherein the float vehicles comprise inner tubes.

18. A water attraction for interactive game play, the water attraction comprising:

means for electronically identifying play participants in an interactive water game environment, wherein said means for electronically identifying further comprises, means for storing identification information associated with one of the play participants, means for wirelessly transmitting the identification information, and means for substantially enclosing at least said storing means and said transmitting means, said enclosing means configured to be worn on a hand portion of the one of the play participants;

means for wirelessly communicating with the means for electronically identifying, said means for wirelessly communicating being disposed in or around multiple locations of a body of water, said means for wirelessly communicating being further configured to play an interactive game with the play participants in possession of said means for electronically identifying such that each of the play participants completes various challenges to progress in the interactive game; and means for transporting the play participants on the body of water during the course of the interactive game.

19. The water attraction of claim 18, wherein the means for electronically identifying is further configured to communicate a command signal to the means for wirelessly communicating to cause at least one play effect.

20. The water attraction of claim 19, further comprising means for tracking a progress of the play participants in the interactive game.

* * * * *